United States Patent [19]

van Wieringen

[11] Patent Number: 4,510,722

[45] Date of Patent: Apr. 16, 1985

[54] DEVICE ADAPTED TO MOUNT A METAL JAMB OR FRAME, MORE PARTICULARLY A DOOR JAMB, INTO A WALL OPENING

[75] Inventor: Gijsbertus L. van Wieringen, Amersfoort, Netherlands

[73] Assignee: N.V. Nederlandse Metaalindustrie Polynorm, Netherlands

[21] Appl. No.: 470,099

[22] Filed: Feb. 28, 1983

[30] Foreign Application Priority Data

Mar. 3, 1982 [NL] Netherlands ..... 8200848

[51] Int. Cl.[3] ..... E06B 1/04

[52] U.S. Cl. ..... 52/213; 52/217; 49/505

[58] Field of Search ..... 52/217, 213, 208, 214; 49/505, 504, 217

[56] References Cited

U.S. PATENT DOCUMENTS

| | | | |
|---|---|---|---|
| 2,582,765 | 1/1952 | Brew | 49/505 |
| 2,700,441 | 1/1955 | Cadini | 52/217 |
| 3,445,977 | 5/1969 | Latiano | 49/505 |
| 3,553,891 | 1/1971 | Casebolt et al. | 49/505 |
| 3,788,019 | 1/1974 | Kiselewski | 49/505 |
| 4,251,962 | 2/1981 | Langenhorst | 49/504 |

FOREIGN PATENT DOCUMENTS

| | | | |
|---|---|---|---|
| 1509380 | 8/1969 | Fed. Rep. of Germany | 49/505 |
| 2810981 | 9/1979 | Fed. Rep. of Germany | 52/213 |

*Primary Examiner*—Henry E. Raduazo

*Attorney, Agent, or Firm*—Basile, Weintraub & Hanlon

[57] ABSTRACT

A device adapted to mount a metal jamb or frame, more particularly a door jamb 3 having a U-shaped cross-section into a wall opening, said device comprising a fixing plate 6 to be mounted against the reveal 2 of a wall opening and an adjustable bracket 8, connected to the fixing plate in a slidable and fixable manner.

The fixing plate 6 consists of an oblong plate extending over almost the entire width of the reveal and comprises at each end relatively short side flanges 9 projecting from the wall, while the adjustable bracket 8 has a U-shape with two legs 14 embracing the wall in a mounted position said legs being engageable with the side flanges of the fixing plate, while said legs are also provided with means 16, 20 for receiving end flanges of a frame to be mounted.

4 Claims, 2 Drawing Figures

DEVICE ADAPTED TO MOUNT A METAL JAMB OR FRAME, MORE PARTICULARLY A DOOR JAMB, INTO A WALL OPENING

BACKGROUND OF THE INVENTION

1. Field of the Invention

The present invention relates to a device adapted to mount a metal jamb or frame, more particularly a door jamb into a wall opening.

2. Description of the Prior Art

Various devices have been used in the art for mounting a jamb or frame with a substantially U-shaped cross-section, into a wall opening, that said jamb can be set on the reveal of said wall opening into an accurately vertical position.

Such known devices frequently have a complicated construction, making mounting very time-consuming.

SUMMARY OF THE INVENTION

It is a main object of the present invention to overcome this shortcoming and to provide a device enabling a jamb or frame to be mounted and adjusted in a simple manner such a device can be manufactured inexpensively due to its simple construction.

This is achieved according to the present invention. In the present invention the fixing plate of the respective device is formed by a oblong strip-shaped plate extending over almost the entire width of the reveal. At each end, relatively short side flanges project from the wall, each side flange being provided with a bore hole. The adjustable bracket is connected to said fixing plate in a slidable and fixable relation, having a U-shape with two legs embracing the wall in the mounted position. The legs are provided with slot-shaped openings for adjustably mounting the bracket to the side flanges of the fixing plate. The legs are further provided with receiving members for the receipt of a frame to be mounted.

This type of construction has the advantage that the adjustable bracket can be easily mounted and positioned, so that the frame to be subsequently secured thereto assumes directly its proper position.

According to the invention, the receiving members consist of an outwardly flanged lip formed on each free end of the legs. Outwardly directed pressed-in portions are provided in the legs at a certain distance from each lip, so that an end flange of a frame to be mounted can be locked between the lip and the pressed-in portions.

Thus, a frame to be mounted can be pushed upon the adjustable bracket(s) as set, until its (their) end flanges snap into the space between the lip and the pressed-in portions. The frame is tightly connected to the adjustable bracket, due to its own resilient action.

The features of the present invention which are believed to be novel are set forth with particularity in the appended claims.

Many attendant advantages will be more readily appreciated as the same becomes better understood by reference to the following detailed description when considered in connection with the accompanying drawings in which like reference symbols designate like parts throughout the figures.

DESCRIPTION OF THE PREFERRED EMBODIMENTS

Figure 1:
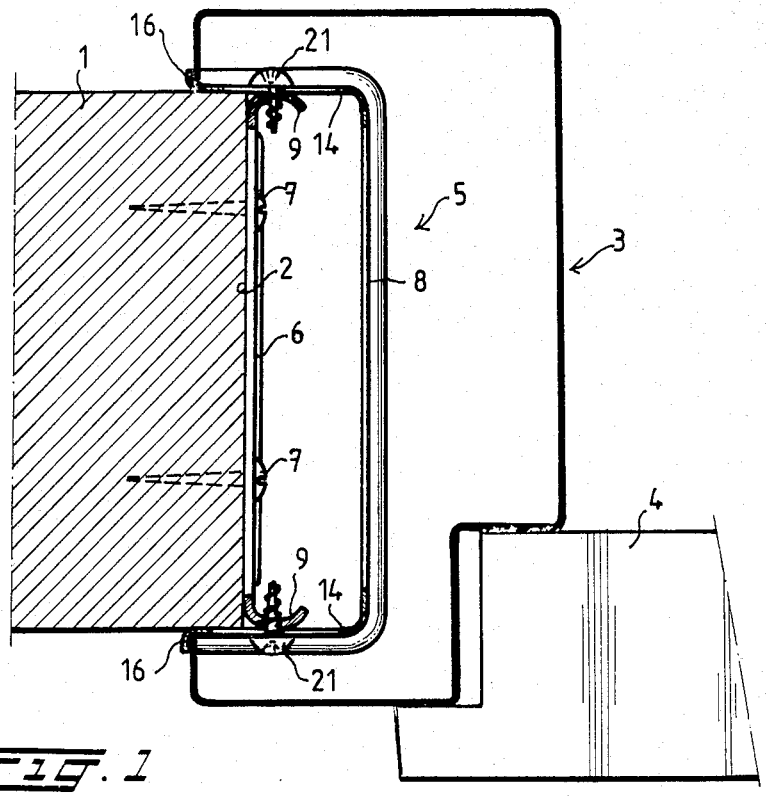
FIG. 1 is a horizontal sectional view of a door jamb mounted by means of the device according to the invention.

Referring now to FIG. 1 a wall 1 with a reveal 2 of a door opening is illustrated. In the opening there is a jamb 3 provided for a door 4 and mounted by means of a device 5 located on the reveal 2. The jamb 3 has a substantially U-shaped cross-section and comprises end flanges directed toward one another.

Figure 2:
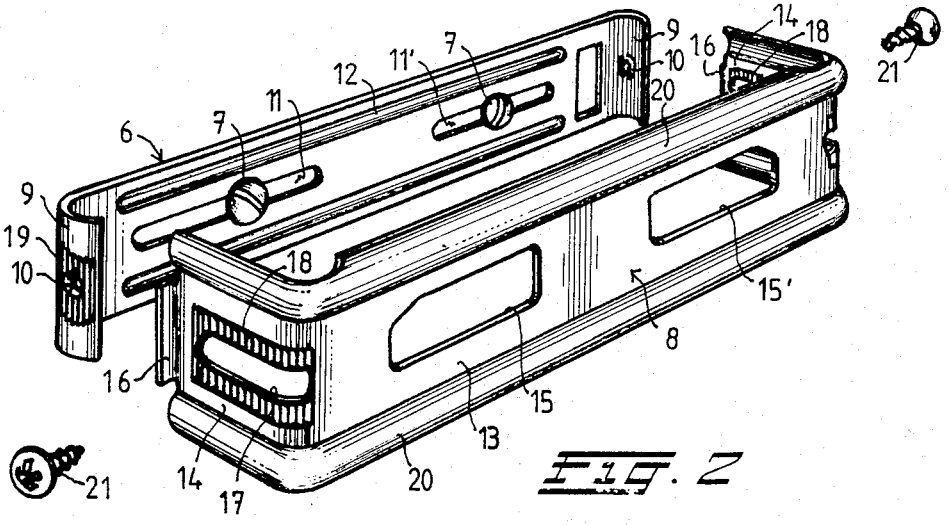
FIG. 2 is an exploded view of the device of FIG. 1.

Referring now to FIG. 2, as is particularly evident, the device according to the invention consists of a fixing plate 6 which can be mounted on the reveal 2 of a wall opening by means of screws 7, and of a U-shape adjustable bracket 8 connected to the fixing plate 6 in a slidable and fixable manner.

The fixing plate 6 comprises an oblong strip-shaped element the length of which practically corresponds to the thickness of the wall 1, at each end comprising relatively short side flanges 9 projecting from the wall, each flange being provided with a bore hole 10. The central portion of the fixing plate 6 is provided with two slot-shaped openings 11, 11' extending in the longitudinal direction of the plate, provided for the screws 7. The fixing plate may also be provided with reinforcement ribs 12.

The U-shaped adjustable bracket 8 likewise has the form of a strip and consists of a body 13 and two side legs 14, embracing the wall in the mounted position. Said body 13 is provided with openings 15, 15' roughly corresponding to the openings 11, 11' in the fixing plate 6, so that the screws 7 can be fitted without having to loosen the adjustable bracket from the fixing plate. The side legs 14 of the adjustable bracket 8 are provided on their free ends with an outwardly flanged lip 16. Both legs 14 are also provided with a slot-shaped opening 17 extending in the longitudinal direction thereof, the surface along said opening being provided with a roughening 18 both on the outer and on the inner sides of said legs. The outside portions of the flanges 9 of the fixing plate 6 which engage the inner side of the legs 14, are also provided with a corresponding roughening 1. The upper and lower longitudinal edges of the adjustable bracket 8 comprise reinforcement ribs 20 extending over the entire length of the bracket. The end portions of these ribs form, in conjunction with the lips 16, the receiving members on which the end flanges of a jamb 3 are to be mounted.

Mounting jamb 3 proceeds in the following manner. Several fixing plates 6, properly spaced from one another, are secured to the reveal 2 of the wall opening by means of screws 7. Thereupon, the U-shaped adjustable bracket(s) 8 is or are connected to the fixing plates 6; secured thereto for instance by means of self-tapping screws 21 which engage the side flanges 9 through the bore holes 10 and successively pass through the slots 17 provided in the legs 14. Subsequently, the adjustable brackets of the various devices are secured after being properly positioned in relation to one another by means of the slots 17. The roughened portions 18, 19 ensure that the U-shaped adjustable brackets 8 are tightly secured in relation to the fixing plates 6, so that they cannot move when the jamb 3 is being mounted. The jamb 3 is pushed over the U-shaped adjustable bracket(s) 8 until the end flanges of the jamb 3 snap into the space provided between the lip 16 and the end portions of the reinforcement ribs 20. Due to the resilient action of the frame itself, said end flanges remain solidly locked, thus precluding the need for additional fastening means.

Both the fixing plate 6 and the U-shaped adjustable bracket 8 have a particularly simple construction and can be made from sheet iron in an easy and inexpensive manner.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A device adapted to mount a metal frame or jamb, more particularly a door jamb, into a wall opening, said door jamb having a substantially U-shaped cross-section and comprising:

a fixing plate to be mounted on the reveal of a wall opening and formed by an oblong strip-shaped plate, extending over almost the entire width of said reveal; each end of the fixing plate comprising relatively short side flanges projecting from the wall; each side flange being provided with a bore hole;

an adjustable bracket;

means for connecting said adjustable bracket to said fixing plate in a slidable and fixable relation;

the bracket having a U-shape and two legs embracing the wall in the mounted position; said legs being provided with slot-shape openings for adjustably mounting the bracket to the side flanges of the fixing plate, said legs further being provided with receiving members for the receipt of a frame to be mounted.

2. A device according to claim 1, wherein the receiving members consist of an outwardly flanged lip formed on each free end of the legs and of outwardly directed pressed-in portions provided in the legs at a certain distance from each lip, so that an end flange of a frame to be mounted can be locked between the lip and the pressed-in portions.

3. A device according to claim 2, wherein said pressed-in portions are formed by reinforcement ribs extending over almost the entire length of the adjustable bracket.

4. A device according to claim 1, wherein in the side legs of the adjustable bracket provided with oblong slots extending over almost the entire length thereof, the surface area around said slots is provided with roughened portions both on the inner and on the outer sides of said legs, the outer surface of the fixing plate flanges also being provided with roughened portions.

* * * * *